US008579185B2

(12) United States Patent
Aldridge et al.

(10) Patent No.: US 8,579,185 B2
(45) Date of Patent: Nov. 12, 2013

(54) ROUNDED PACKAGING FOR COMESTIBLES

(75) Inventors: Allen Aldridge, South Orange, NJ (US); Simon Richard Gainey, Media, PA (US); Rita Dombroski, Claymont, DE (US)

(73) Assignee: Kraft Foods Global Brands LLC, Northfield, IL (US)

( * ) Notice: Subject to any disclaimer, the term of this patent is extended or adjusted under 35 U.S.C. 154(b) by 451 days.

(21) Appl. No.: 12/663,463

(22) PCT Filed: Jun. 6, 2008

(86) PCT No.: PCT/US2008/007141

§ 371 (c)(1),
(2), (4) Date: Apr. 5, 2010

(87) PCT Pub. No.: WO2008/153955

PCT Pub. Date: Dec. 18, 2008

(65) Prior Publication Data

US 2010/0224644 A1 Sep. 9, 2010

Related U.S. Application Data

(60) Provisional application No. 60/942,631, filed on Jun. 7, 2007.

(51) Int. Cl.
*B65D 51/04* (2006.01)
*B32B 38/00* (2006.01)

(52) U.S. Cl.
USPC ..... 229/149; 220/810; 206/800

(58) Field of Classification Search
USPC ..... 229/103.2; 426/108; 206/271, 800, 474; 220/604, 623; 190/1, 107
See application file for complete search history.

(56) References Cited

U.S. PATENT DOCUMENTS 969,329 A * 9/1910 Blake ..... 220/504
2,308,003 A * 1/1943 Gamrod ..... 294/139

(Continued)

FOREIGN PATENT DOCUMENTS

| | | | |
|---|---|---|---|
| CH | 381514 | A | 8/1964 |
| DE | 3517176 | A1 | 11/1986 |
| DE | 9002504.0 | U1 | 5/1990 |
| EP | 0201043 | A2 | 12/1986 |

OTHER PUBLICATIONS

Supplementary EPO Search Report issued in corresponding EPO application No. EP 08768214.

*Primary Examiner* — Gary Elkins
*Assistant Examiner* — Christopher Demeree
(74) *Attorney, Agent, or Firm* — Hoffmann & Baron, LLP

(57) ABSTRACT

The present invention includes a package for holding comestible products and blanks for forming the same. The packages can have opposing side walls with generally rounded contoured bottom and top ends and bottom and top walls that conform to the round bottom and top end so that the bottom and top walls have a curved surface that follows the curvature of the bottom and top ends.

13 Claims, 14 Drawing Sheets

(56) References Cited

U.S. PATENT DOCUMENTS

| | | | | | |
|---|---|---|---|---|---|
| 4,019,674 | A | * | 4/1977 | Ikelheimer et al. | 229/122.22 |
| D365,206 | S | * | 12/1995 | Goodman | D3/273 |
| D480,174 | S | * | 9/2003 | Draghetti et al. | D27/189 |
| 7,325,686 | B2 | * | 2/2008 | Aldridge | 206/460 |
| 2003/0106928 | A1 | * | 6/2003 | Li Vigni et al. | 229/146 |
| 2004/0011616 | A1 | * | 1/2004 | Rasmussen | 190/107 |
| 2005/0255198 | A1 | | 11/2005 | Aldridge | |
| 2005/0269233 | A1 | | 12/2005 | Aldridge | |
| 2005/0281920 | A1 | | 12/2005 | Maskell et al. | |

* cited by examiner

ROUNDED PACKAGING FOR COMESTIBLES

The present application claims priority to provisional patent Application Ser. No. 60/942,631 filed Jun. 7, 2007, the disclosure of which is incorporated herein by reference in its entirety.

FIELD OF THE INVENTION

The present invention relates generally to packages for containing various products. More particularly, the present invention relates to a package, with contoured ends, for containing and dispensing comestible products, such as confectionery products including candy and gum.

BACKGROUND OF THE INVENTION

Chewing gum is currently available to consumers in a variety of different formats. These include stick gum, slab gum, pellet gum, extruded gum, and others. In recent years, packaging for gum has undergone various changes. A variety of types of gum packaging, including certain types of packaging used predominantly for one or the other of the gum formats, are available to consumers.

Slabs of gum have often been sold in foil packages. Originally, these slabs were arranged in a package in a side-to-side manner, perhaps including five to seven slabs per package. More recently, these slabs have been arranged within the foil packages in a face-to-face manner, allowing 15-20 slabs to be contained in a convenient package. Slabs are also offered in packages where the slabs lay side-by-side in a compartment formed by the packaging, where a cover moves between a closed and open position to permit dispensing. Such packaging typically has broad front and back panels on which product information can be placed. These panels are typically joined with additional panels at right angles to form the package. The joining of the panels form edges unpleasant to the touch and make the package difficult to insert and remove from pockets and hand bags.

Accordingly, it would be desirable to provide a package which is pleasure to the touch and is easy to insert and remove from pockets, hand bags, and the like.

SUMMARY OF THE INVENTION

In one aspect, a package for holding one or more comestible products is disclosed. The package includes a compartment formed by a bottom wall, back wall, and front wall, which can be formed from a single continuous piece of material. Opposing side walls, which can be formed by tabs included in the single continuous piece of matter or separately formed end caps are provided that have rounded contoured top and bottom ends. The opposing side walls are operatively coupled to at least one of the front wall and the back wall. The bottom wall conforms to the rounded contoured bottom ends of the side walls so that the bottom wall has a curved surface that corresponds to a curvature of the rounded contoured bottom ends of the side walls. The package also includes a cover flap that extends from the back wall and interfaces with the front wall to close the compartment. The cover flap forms a top wall that conforms to the rounded contoured top ends of the opposing side walls when the cover flap is closed so that the top wall has a curved surface that follows a curvature of the rounded top ends of the opposing side walls.

In another aspect, a method of forming a package for holding one or more comestible products is disclosed. The method includes obtaining a blank having at least a front wall section, a back wall section, a bottom section and folding at least one of the front wall section and the back wall section towards the other to form a front wall and a back wall so that the front wall section and the back wall section have a substantially parallel relation. The method also includes forming opposing side walls having rounded contoured top and bottom ends, the opposing side walls being operatively coupled to at least one of the front wall and the back wall and conforming the bottom wall section to the bottom ends of the side wall tabs to form a bottom wall having a curved surface that follows a curvature of the rounded contoured bottom ends of the side walls.

In yet another aspect, a package for holding one or more comestible products is disclosed. The package includes a bottom wall, back wall, front wall, cover flap, and opposing side walls continuously formed from a single piece of material to provide a compartment for holding one or more comestible products. The opposing side walls have rounded contoured top and bottom ends and the bottom wall conforms to the rounded contoured bottom ends of the side walls so that the bottom wall has a curved surface that corresponds to a curvature of the rounded contoured bottom ends of the side walls. The cover flap extends from the back wall and interfaces with the front wall to selectively close the compartment. The cover flap forms a top wall conforming to the rounded contoured top ends of the opposing side walls when the cover flap is closed so that the top wall has a curved surface that follows a curvature of the rounded top ends of the opposing side walls.

Other objects and features of the present invention will become apparent from the following detailed description considered in conjunction with the accompanying drawings. It is to be understood, however, that the drawings are designed as an illustration only and not as a definition of the limits of the invention.

DETAILED DESCRIPTION OF THE PREFERRED EMBODIMENT

The preferred embodiments of the present invention include packages for containing and dispensing a comestible product. In particular, the present invention may be used for containing and dispensing confectionery products such as gum pieces, hard candy, or other comestibles. While the particular embodiments shown herein are employed to contain gum pieces, it may be appreciated that the package may contain any type of product. Such product may also include other confectionery products such as gum in various sizes and shapes, such as sticks, slabs, pillows, pellets and the like as well as other confectionery products, such as hard candy, chocolate, and the like. The product could include multiple pieces or be a single unitary piece. Also, non-confectionery products may be contained and dispensed in accordance with embodiments of the present invention.

The packages disclosed herein can have generally rounded bottom and top walls. The front and back walls also include curved portions that extend to the bottom and top walls so that the transition from the top and bottom walls to the front and back walls is generally smooth without abrupt changes in the direction of the surface of the bottom, top, front, and back walls. In some embodiments, the packages can be formed from a single continuous piece of material and in other embodiments the packages can be formed from multiple pieces of material. The rounded packages have a smooth curved body which is pleasant to the touch and can also be easily slid in and out of pockets and hand bags.

Figure 1:
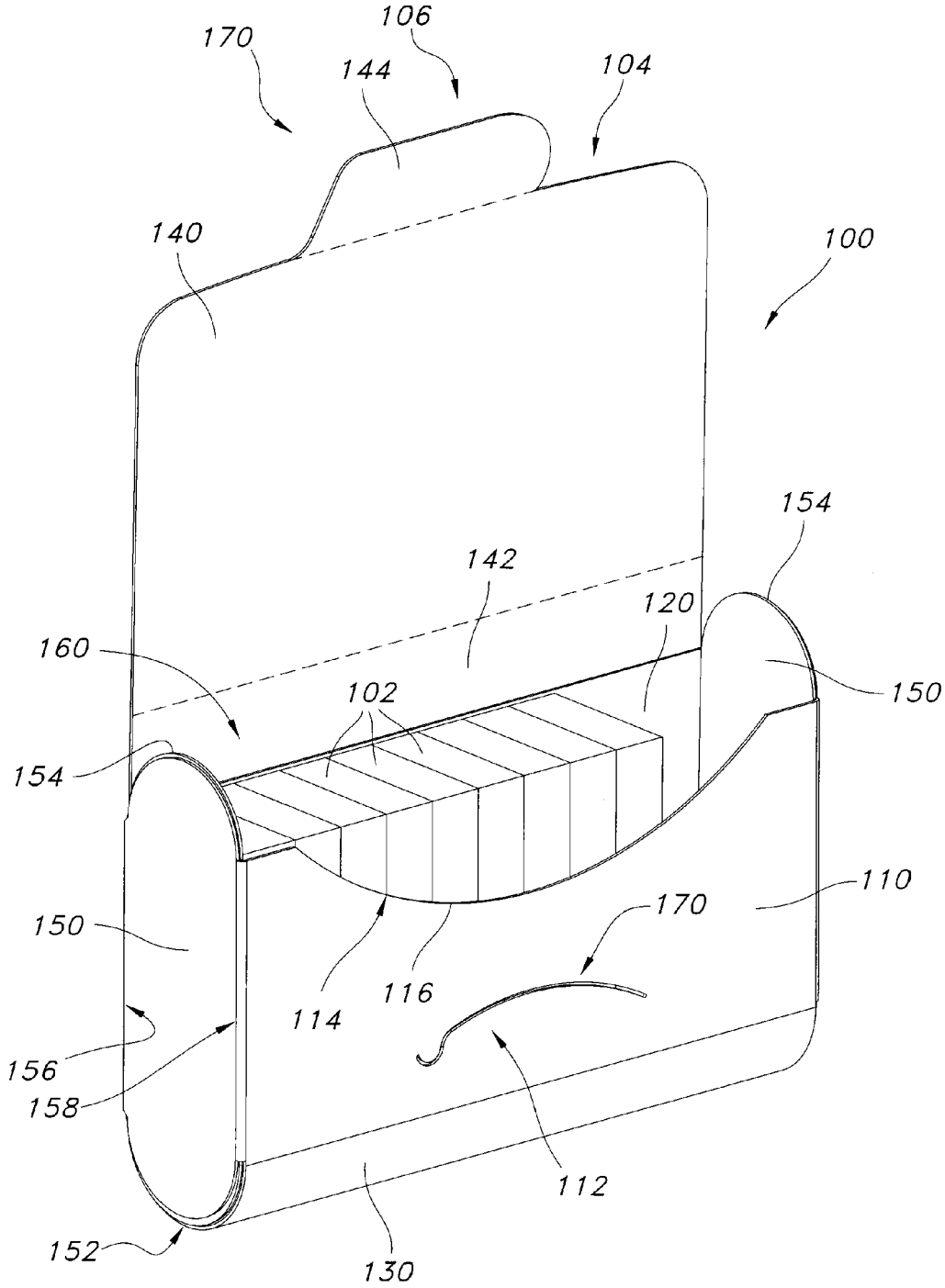
FIG. 1 shows a perspective view of a package in an open position that can be formed in accordance with preferred embodiments of the present invention.
Figure 2:
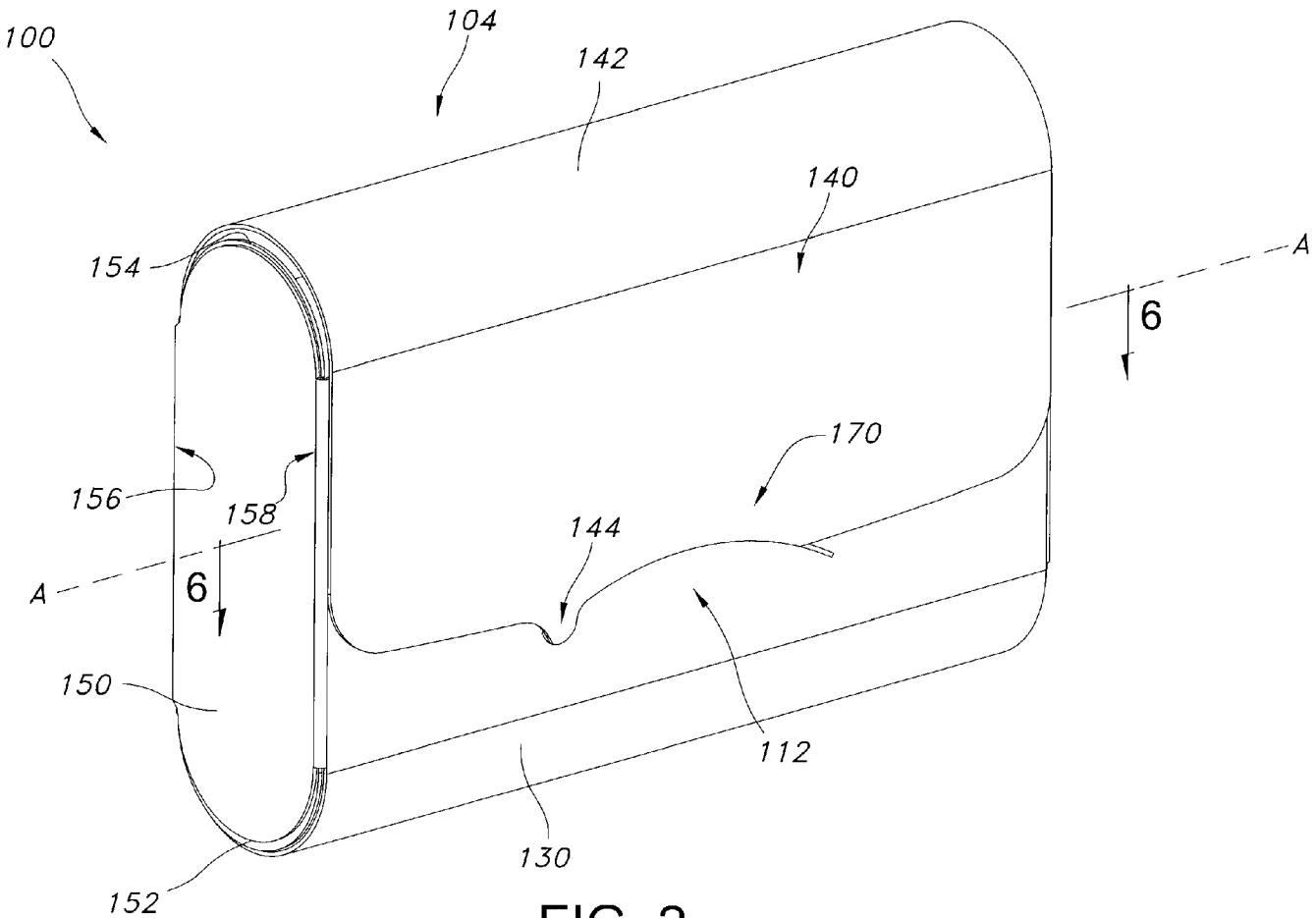
FIG. 2 shows a perspective view of the package of FIG. 1 in an closed position.
Figure 3:
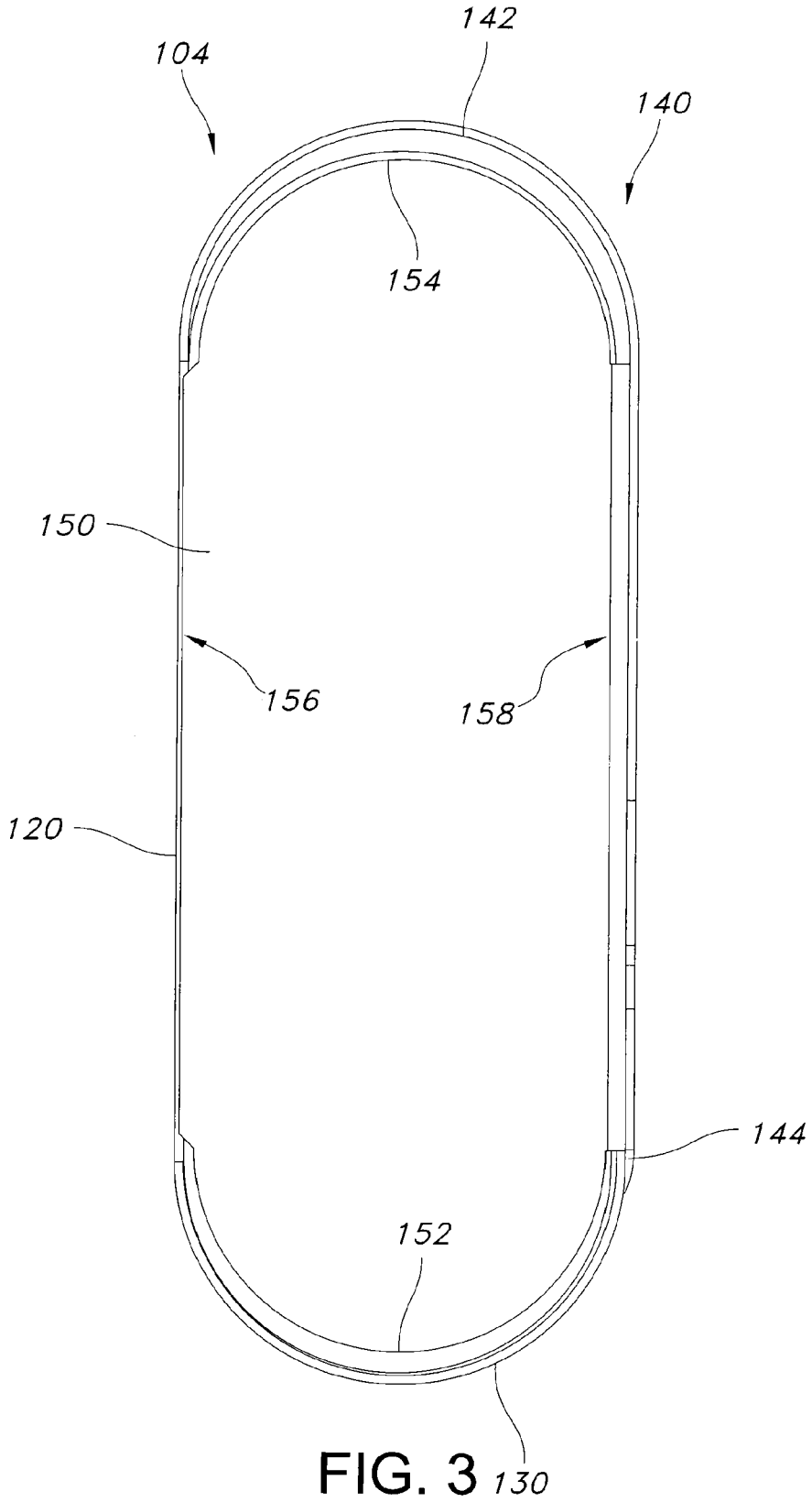
FIG. 3 shows a side view of the package of FIG. 1 in a closed position.

FIGS. 1-3 show one embodiment of a package 100. The package 100 is used to contain and dispense product pieces 102 which can be contained in loose orientation within the package 100. The product pieces 102 may be any size, shape, or configuration including slabs, pellets and sticks. While individual discrete slabs are shown, it is contemplated that the package 100 may contain one or more products having portions thereof that can be broken away or detached for use. Moreover, while unwrapped product pieces 102 are shown, the package 100 may contain individually wrapped pieces.

The package 100 includes a front wall 110, back wall 120, bottom wall 130 and a cover flap 140. The package 100 further includes a pair of opposing side walls 150. The various walls 110, 120, 130, and 150 form a compartment 160 in which comestible product pieces 102 can be held. The comestible product pieces 102 can be held in one or more row-like arrangements and can be individual wrapped or unwrapped gum pieces. The package 100 may be covered by a plastic overwrap (not shown) of a type known in the art, which is removable by a user prior to dispensing the comestibles.

The front wall 110, back wall 120, bottom wall 130, and cover flap 140 can be formed from a continuous sheet of material, such as paperboard or other suitable material. The package 100 can also include a closure 170 having a first element 112 disposed on the front wall 110 and a second element 144 disposed on the cover flap 140. The first element 112 can be used to selectively hold the cover flap 140 in a closed position, as shown in FIGS. 2 and 3. The first element 112 can be a portion of a hook and loop mechanism (e.g., Velcro®), a snap, magnetic material, an opening, or the like, disposed on and/or formed in the front wall 110. In present embodiment, the first element 112 is a slot that can have various configurations and that can be located symmetrically or asymmetrically on the front wall 110. In some embodiments, the slot can have a generally curved configuration where an apex of the curved slot can be in the direction towards the top 104 of the package 100. The notch 114 may be formed at an edge 116 of the front wall. The notch 114 can be formed with a generally arch-shaped configuration and can facilitate greater access to the product pieces 102 held in the compartment 160 of the package 100.

The cover flap 140 extends from the back wall 120 and can be folded over to the front wall 110 to close the package 100, as shown in FIGS. 2 and 3. The cover flap 140 includes a top wall 142 of the package 100 when the cover flap is closed (FIGS. 2 and 3). The second element 144 of the cover flap can interface with the first element 112 of the front wall 110. The second element 144 can be a portion of a hook and loop mechanism (e.g., Velcro®), a snap, magnetic material, a securing tab, or the like, disposed on and/or formed in the cover flap 140. In the present embodiment, the element is a securing tab that extends from a distal end 106 of the cover flap 140. The securing tab can be inserted into a curved slot formed in front wall 110 to selectively retain the cover flap 140 in the closed position when dispensing of the comestible product pieces is not desired. The securing tab can have various configurations and can be located symmetrically or asymmetrically on the cover flap 140. The cover flap 140 can be repeatedly opened, as desired, to permit the comestible product pieces to be removed and then closed to retain those remaining comestible product pieces.

The cover flap 140 can be initially secured to the front wall 110 in the closed position by an adhesive or other suitable tamper proof mechanism. Upon first opening the cover flap 140, the adhesive is overcome. The cover flap 140 can thereafter be retained by interfacing the first and second elements 112 and 144, for example, by inserting the securing tab of the cover flap 140 in the slot of the front wall 110.

The side walls 150 preferably have round contoured bottom and top ends 152 and 154 and can have side ends 156 and 158. The walls 110, 120, and 130 can conform to the shape of the side walls 150 such that the bottom wall 130 has a generally curved surface that follows the curvature of the bottom end 152 of the side walls 150 and the front and back walls 110 and 120 can be curved so that the transition between the bottom wall 130 and the front and back walls 110 and 120 is generally rounded and smooth with no abrupt changes in the direction of the walls during the transition. When the cover flap 140 is in the closed position (FIGS. 2 and 3), the cover flap 140 can form the top wall 142 of the package 100, which can conform to the top ends 154 of the side walls 150 such that the top wall 142 has a generally curved surface that follows the curvature of the top end 154 of the side walls 150. The transition between the back wall 120 and the top wall 142 can be generally rounded and smooth with no abrupt changes in the direction of the walls during the transition. Side walls 150 help initially shape and maintain the curved configuration of the top wall when the cover flap 140 is in the closed position.

In some embodiments, the walls 110, 120, 130, and 150, and the cover flap 140, can be formed from a single continuous piece of material, such as paperboard or other foldable material, that is cut to the desired configuration. Alternatively, other foldable material could also be employed to form the package 100.

Referring to FIG. 2, the package 100 can extend longitudinal along a longitudinal axis line A-A such that the walls 110, 120, 130, and 142 have longitudinal surfaces. In the closed position, the top wall 142 can have a longitudinally curved surface that extends from a first end 190 to a second end 192 of the package 100 so that the entire surface of the top wall 142 is curved. Likewise, the bottom wall 130 can have a longitudinally curved surface that extends from the first end 190 to the second end 192 of the package 100 so that the entire surface of the bottom wall 130 is curved.

Figure 4:
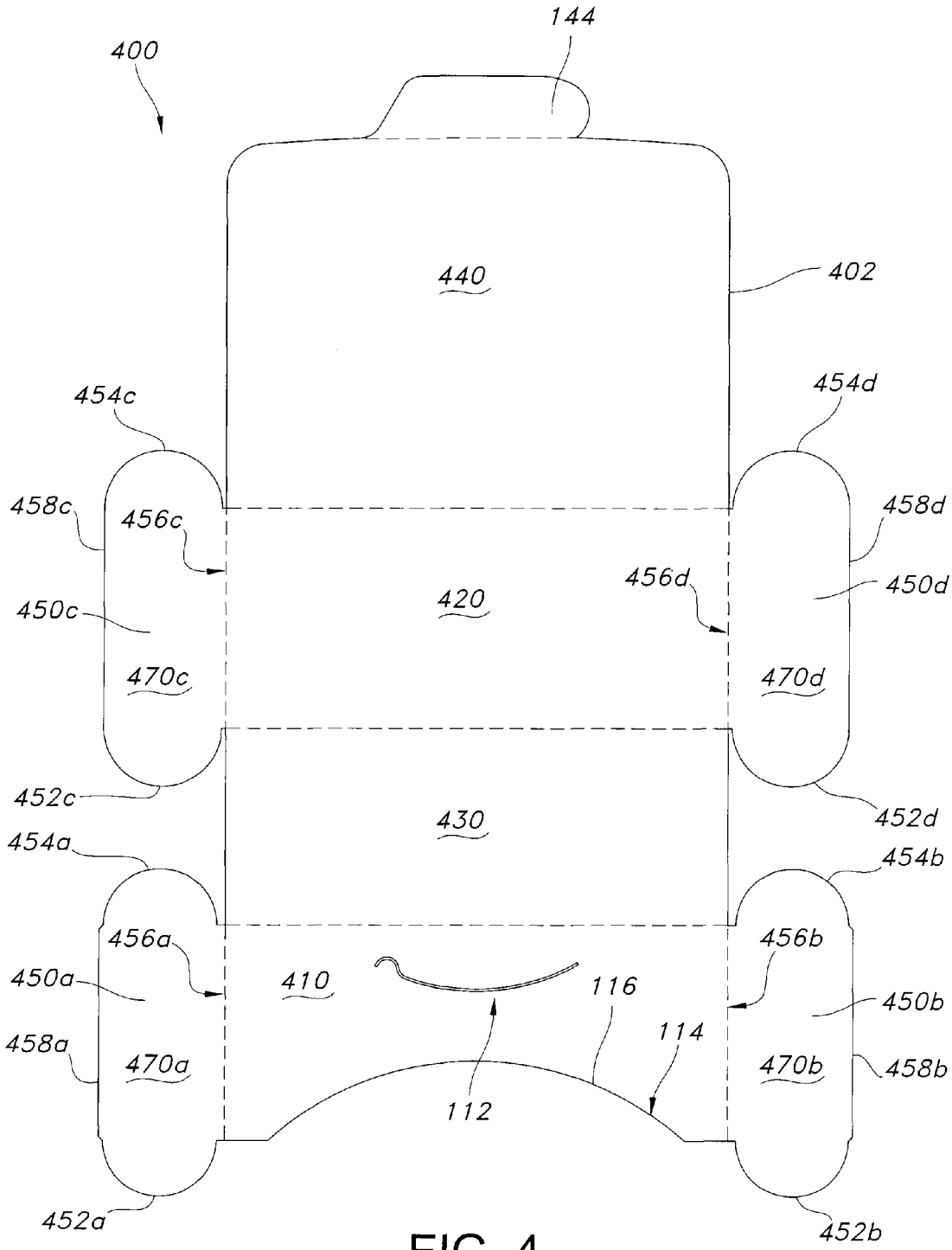
FIGS. 4-5 show an embodiment of a blank that can be used to form the package of FIG. 1.
Figure 5:
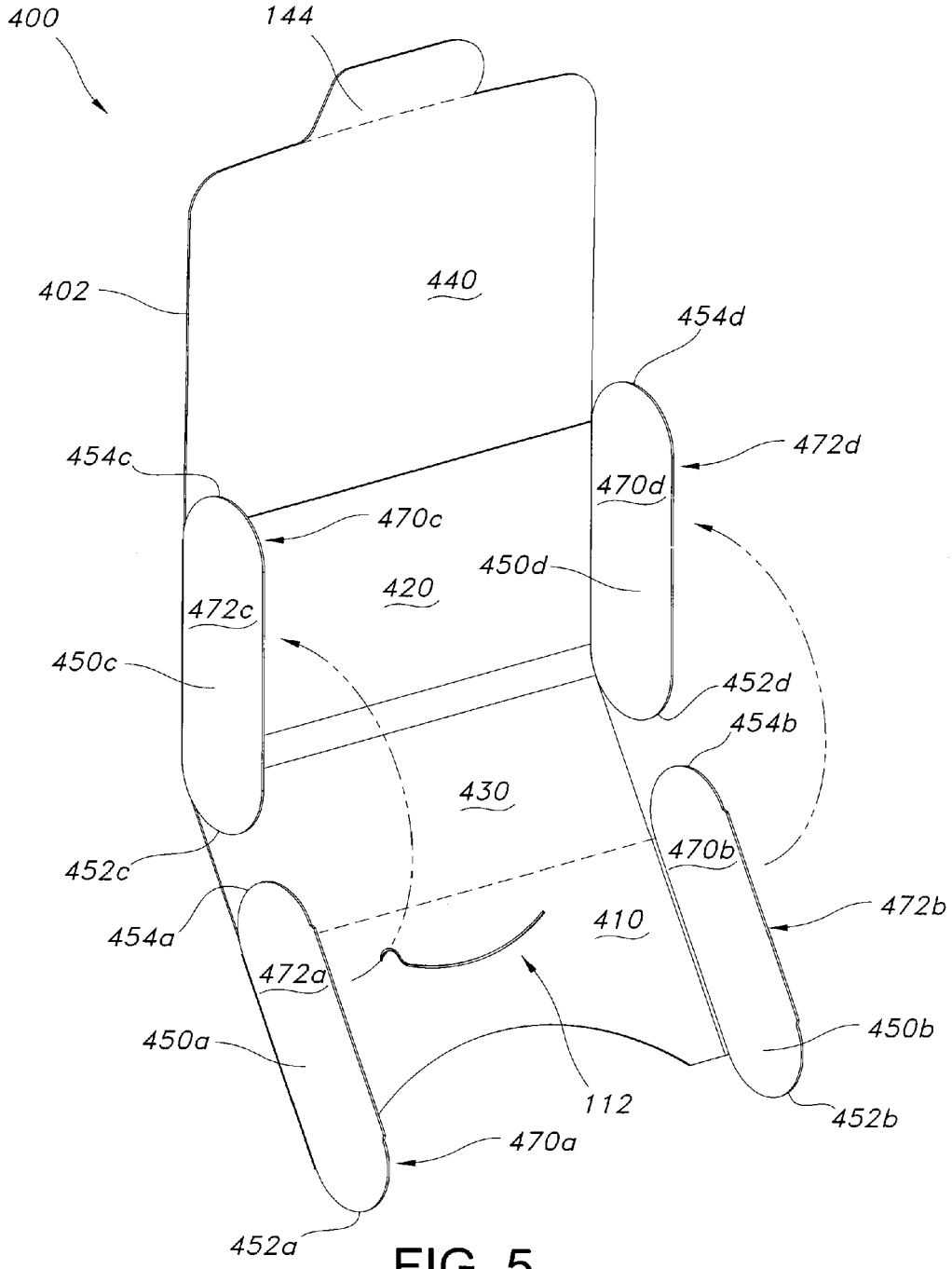
Figure 6:
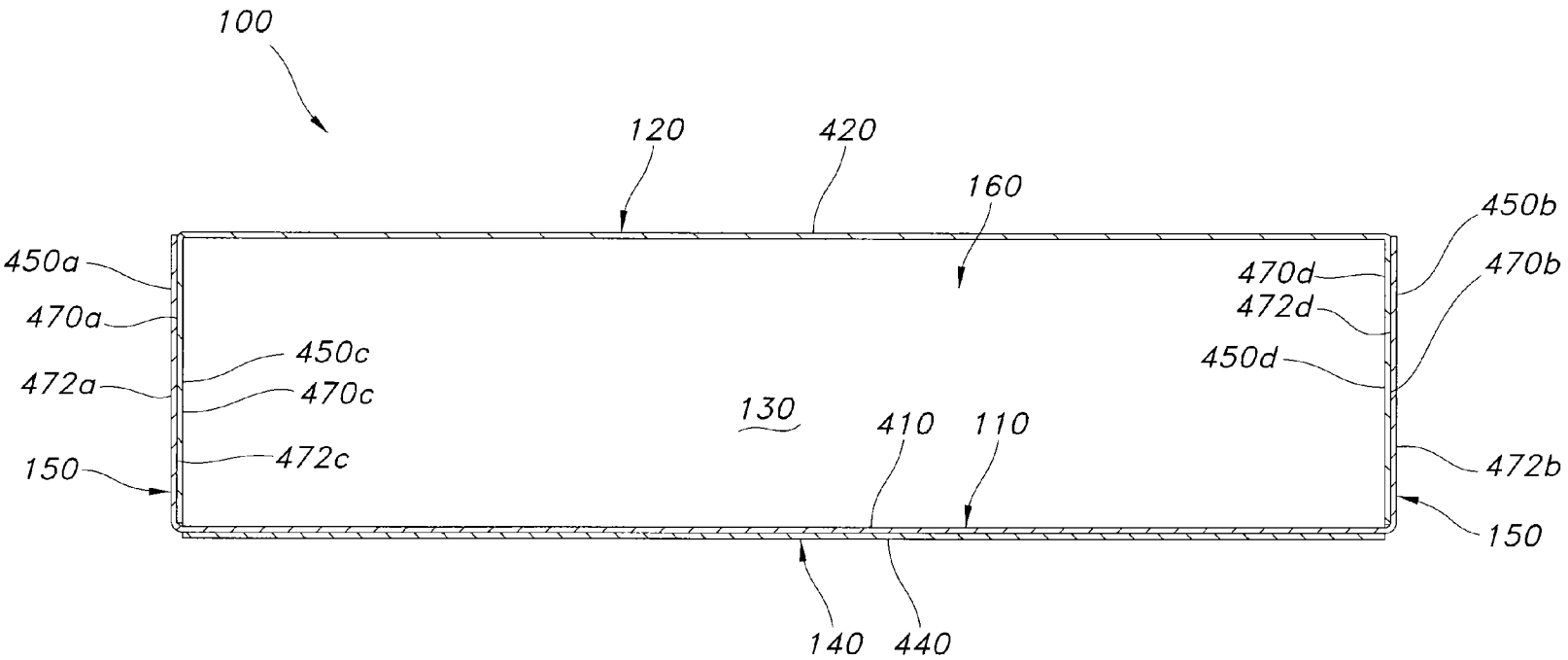
FIG. 6 shows a cross-sectional view from the top of a package formed using the blank of FIGS. 4 and 5.

FIGS. 4-6 depict one embodiment of a blank 400 that can be used to form the package 100. The blank 400 can have a body 402 that can be constructed of a paperboard or other material of suitable strength for holding one or more comestible products. The body 402 can have a front wall section 410, back wall section 420, bottom wall section 430, and a cover flap section 440. The body 402 can be folded in a manner such that the front wall section 410 forms the front wall 110, the back wall section 420 forms the back wall 120, the bottom wall section 430 forms the bottom wall 130, and the cover flap section 440 forms the top wall 142 and the cover flap 140. The front wall section 410 can include the first element 112 and notch 114 and the cover flap section 440 can include the second element 144, as discussed above with reference to the cover flap 140.

The body 402 can also include side wall tabs 450*a-d* which can form the opposing side walls 150 of the package 100. The side wall tabs 450*a-d* can be integrally formed such that side wall tabs 450*a* and 450*b* can be disposed on the sides of the front wall section 410 and side wall tabs 450*c* and 450*d* can be disposed on the sides of the back wall section 420. The side wall tabs 450*a-d* can have generally round contoured top and bottom ends 452*a-d* and 454*a-d*, respectively, and side ends 456*a-d* and 458*a-d*.

Referring to FIGS. 5 and 6, the blank 400 can be formed into the package 100 by folding one or both the front wall section 410 and the back wall section 420 towards the other. The side wall tabs 450*a-d* can be folded so that the side wall tabs 450*a-d* are generally orthogonal to the section on which the side wall tabs 450*a-d* are disposed and so that the inner surfaces 470*a-d* (FIGS. 4-6) of the side wall tabs 450*a-d* are facing each other. The front wall section 410 and/or the back wall section 420 can be folded until the side wall tabs 450*a* and 450*c* substantially overlap and the side wall tabs 450*b* and 450*d* substantially overlap (FIG. 6). To form the package 100, the side wall tabs 450*a* and 450*c* can be operatively coupled and the side wall tabs 450*b* and 450*d* can be operatively coupled. For example, the inner surface 470*a* of the side wall tab 450*a* can be adhesively or otherwise joined to an outer surface 472*c* of the side wall tab 450*c* and the inner surface 470*b* of the side wall tab 450*b* can be adhesively or otherwise joined to an outer surface 472*d* of the side wall tab 450*d*.

Although the present example depicts the side wall tabs 450*c* and 450*d* as being inwardly positioned with respect to the side wall tabs 450*a* and 450*b*, those skilled in the art will recognize that alternative configurations can be implemented. For example, the side wall tabs 450*a* and 450*b* can be inwardly positioned with respect to the side wall tabs 450*c* and 450*d*, respectively, or the side wall tab 450*a* can be inwardly positioned with respect to the side wall tab 450*c* and the side wall tab 450*b* can be outwardly positioned with respect to the side wall tab 450*d*.

As the front wall section 410 and/or the back wall section 420 are folded towards the other, the bottom wall sections 430 folds to conform to the rounded contour of the bottom ends 452 of the side wall tabs 450*a-d*. So that when the bottom wall is formed from the bottom wall section 430, the surface of the bottom wall is rounded having a curvature that is substantially the same as the curvature of the rounded contour of the side walls formed by the side wall tabs 450*a-d* and the transition between the bottom wall and the front and back walls is generally rounded and smooth without abrupt changes in the direction of the surfaces of the walls through the transition. Side wall tabs 450*a-d* help initially shape and maintain the curved configuration of the bottom wall.

Figure 7:
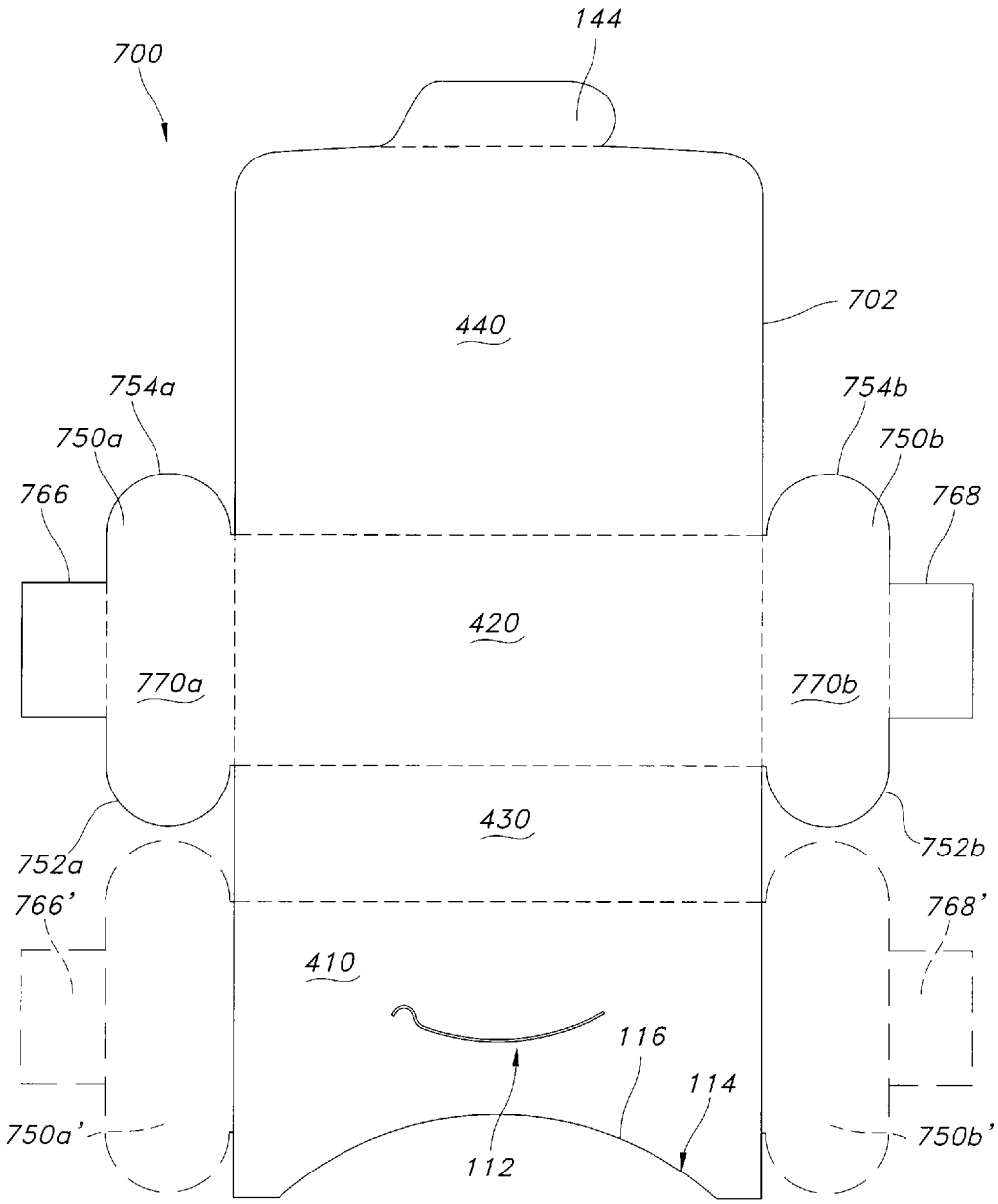
FIGS. 7-8 show an embodiment of a blank that can be used to form the package of FIG. 1.
Figure 8:
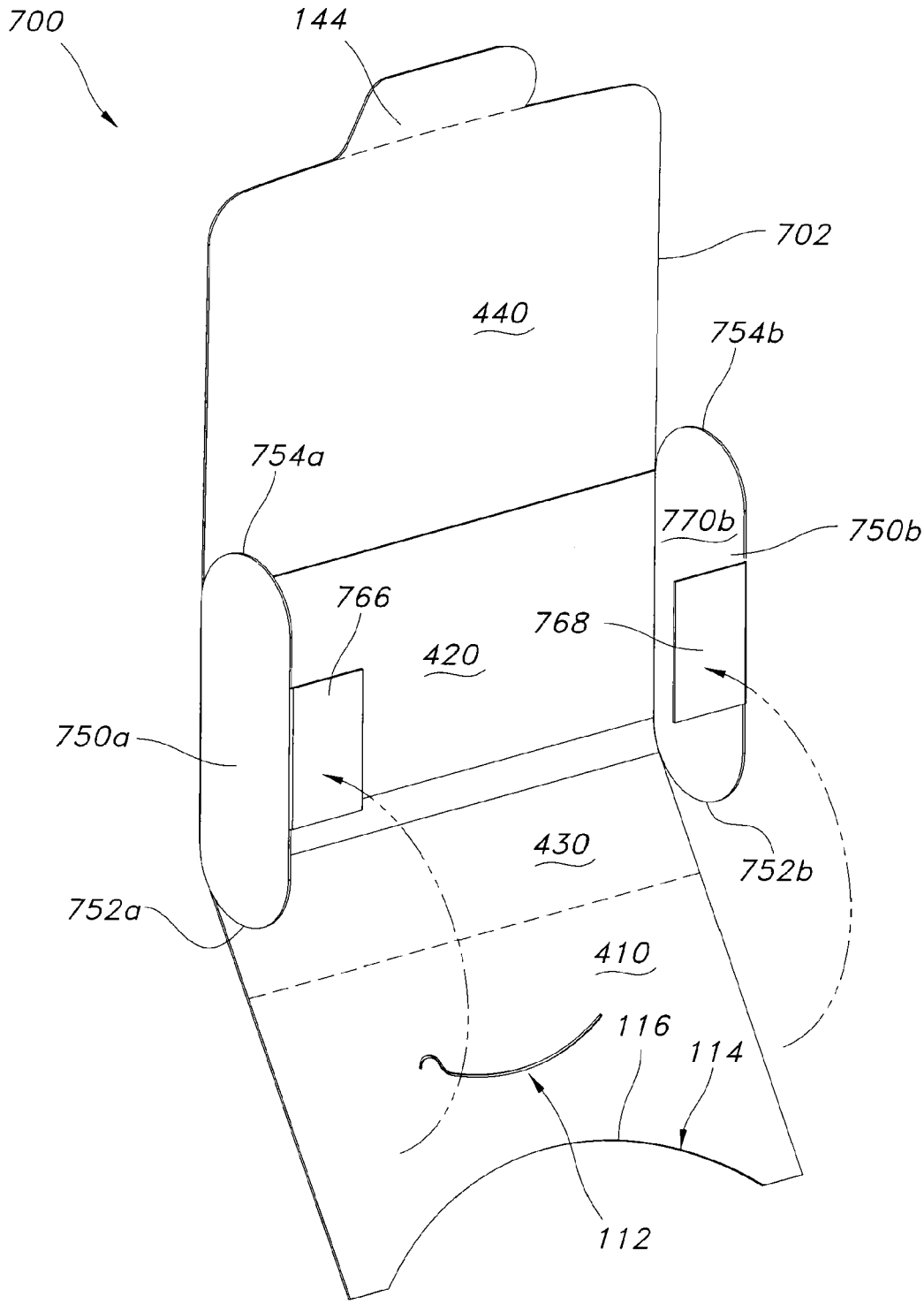
Figure 9:
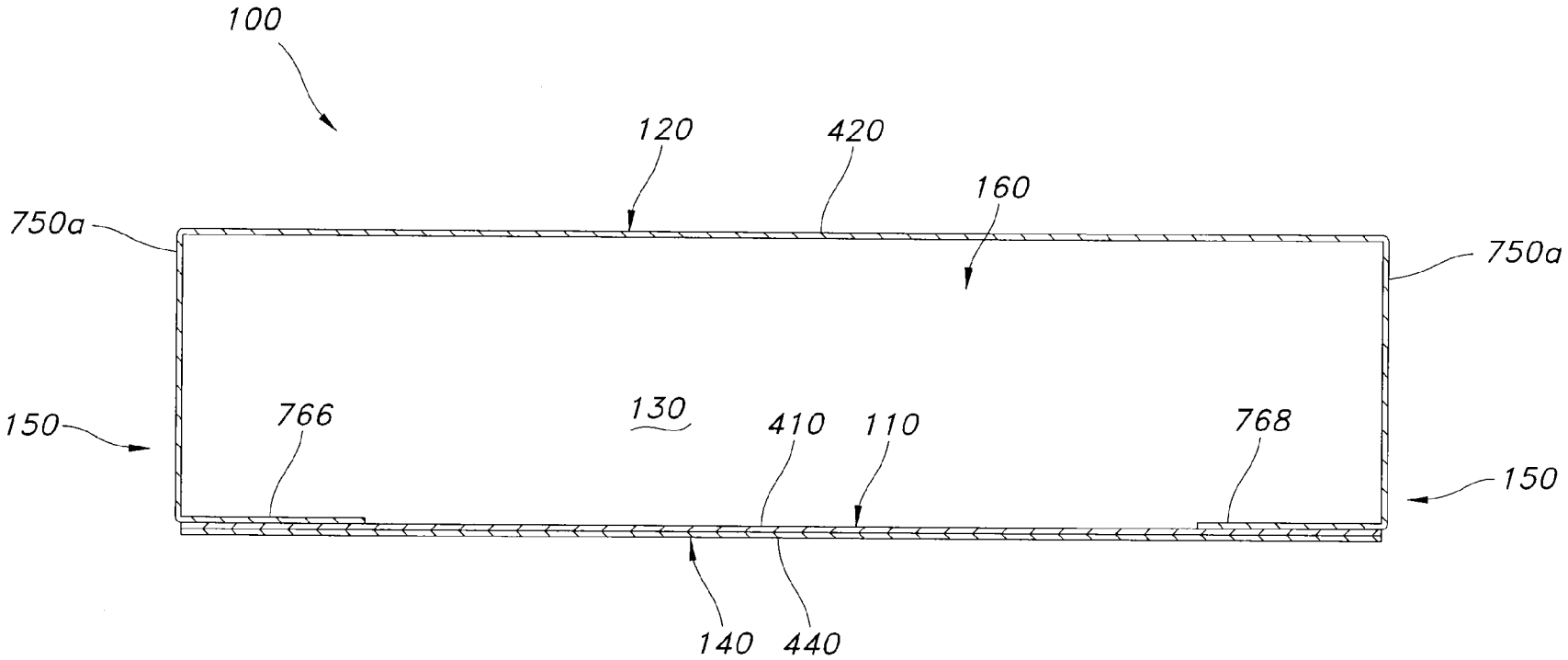
FIG. 9 shows a cross-sectional view from the top of a package formed using the blank of FIGS. 7 and 8.

With reference to FIGS. 7-9, some embodiments of the package 100 can be formed using a blank 700. The blank 700 can include a body 702 that can be constructed of a paperboard or other material of suitable strength for holding one or more comestible products. The body 702 can have the front wall section 410, back wall section 420, bottom wall section 430, and a cover flap section 440. The sections 410, 420, 430, and 440 can be folded in a manner similar to the embodiment described in FIGS. 4-6.

The body 702 can also include side wall tabs 750*a-b* which can form the opposing side walls 150 of the package 100. The side wall tabs 750*a-b* can be integrally formed such that side wall tabs 750*a* and 750*b* can be disposed on the sides of the back wall section 420. The side wall tabs 750*a-b* can have generally round contoured top and bottom ends 752*a-b* and 754*a-b*, respectively. The side wall tabs 750*a* and 750*b* can have extended portions 766 and 768. In the present embodiment, the extended portions 766 and 768 have a generally rectangular configuration, although those skilled in the art will recognize that the extended portions 766 and 768 can have a multitude of configurations.

In some embodiments, side wall tabs 750*a*' and 750*b*' can be disposed on the sides of the front wall section 410 (shown in phantom in FIG. 7) instead of, or in addition to, the side wall tabs 750*a* and 750*b* disposed on the sides of the back wall section 420. The side wall tabs can have extended portions 766' and 768' to provide an area suitable for being operatively coupled the back wall section 420.

Referring to FIGS. 7-9, the blank 700 can be formed into the package 100 by folding one or both the front wall section 410 and the back wall section 420 towards the other. The side wall tabs 750*a-b* can be folded so that the side wall tabs 750*a-b* are generally orthogonal to the section (e.g. the front wall section 410 or the back wall section 420) on which the side wall sections 750*a-b* are disposed and so that the inner surfaces 770*a-b* of the side wall tabs 750*a-b* are facing each other (FIG. 8). The extended portions 766 and 768 can be inwardly folded to have an orthogonal relation to the side wall tabs 750*a-b* such that the extended portions 766 and 768 extend toward each other.

The front wall section 410 and/or the back wall section 420 can be folded towards the other so that the bottom wall section 430 curves to follow the curvature of the side wall tab 750*a-b*. In the present embodiment, the front wall section 410 can be operatively coupled to the extended portions 766 and 768, using, for example, an adhesive in a manner well known in the art. For embodiments in which the side wall tabs 750*a-b* are disposed on the sides of the front wall section 410, the back wall section 430 can be operatively coupled to the extended portions 766 and 768 of the side wall tabs 750*a-b*. As the front and/or back wall sections 410 and 420 are folded towards the other, the bottom wall sections 430 folds to conform to the rounded contour of the side wall tabs 750*a-b*. So that when the bottom wall is formed from the bottom wall section 430, the surface of the bottom wall is rounded having a curvature that is substantially the same as the curvature of the rounded contour of the side walls formed by the side wall tabs 750*a-b*. The cover flap section 440 can be folded downwardly following the curve of the side wall tabs 750. The bottom wall of the package has a rounded configuration and the top wall has a rounded configuration when the package is in the closed position.

Figure 10A:
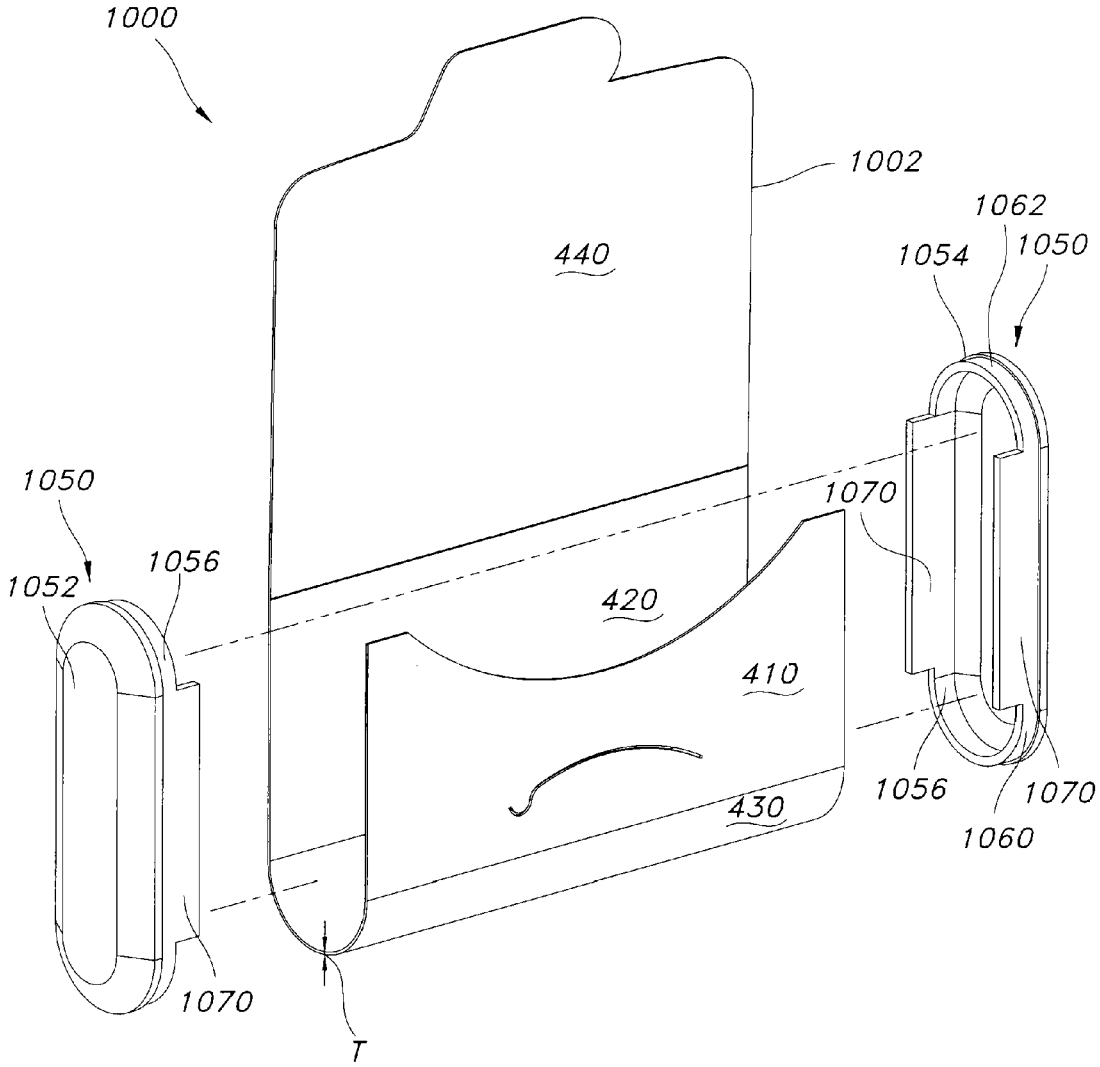
FIGS. 10A-B show alternative blanks and end caps that can be formed in accordance with preferred embodiments of the present invention.
Figure 11A:
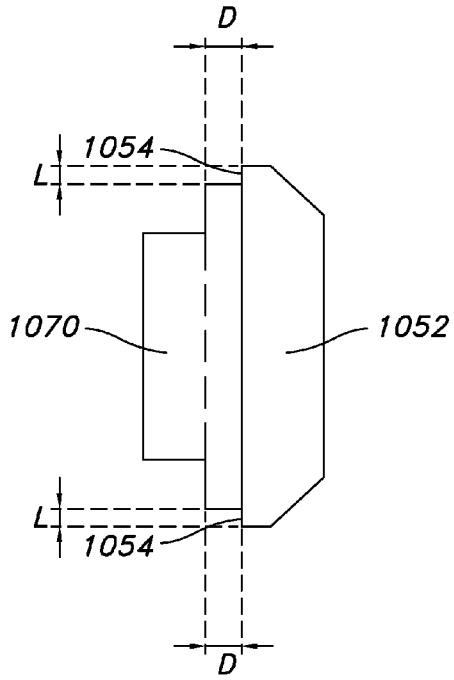
FIGS. 11A-B show a side view alternative end caps that can be used in accordance with preferred embodiments of the present invention.
Figure 12A:
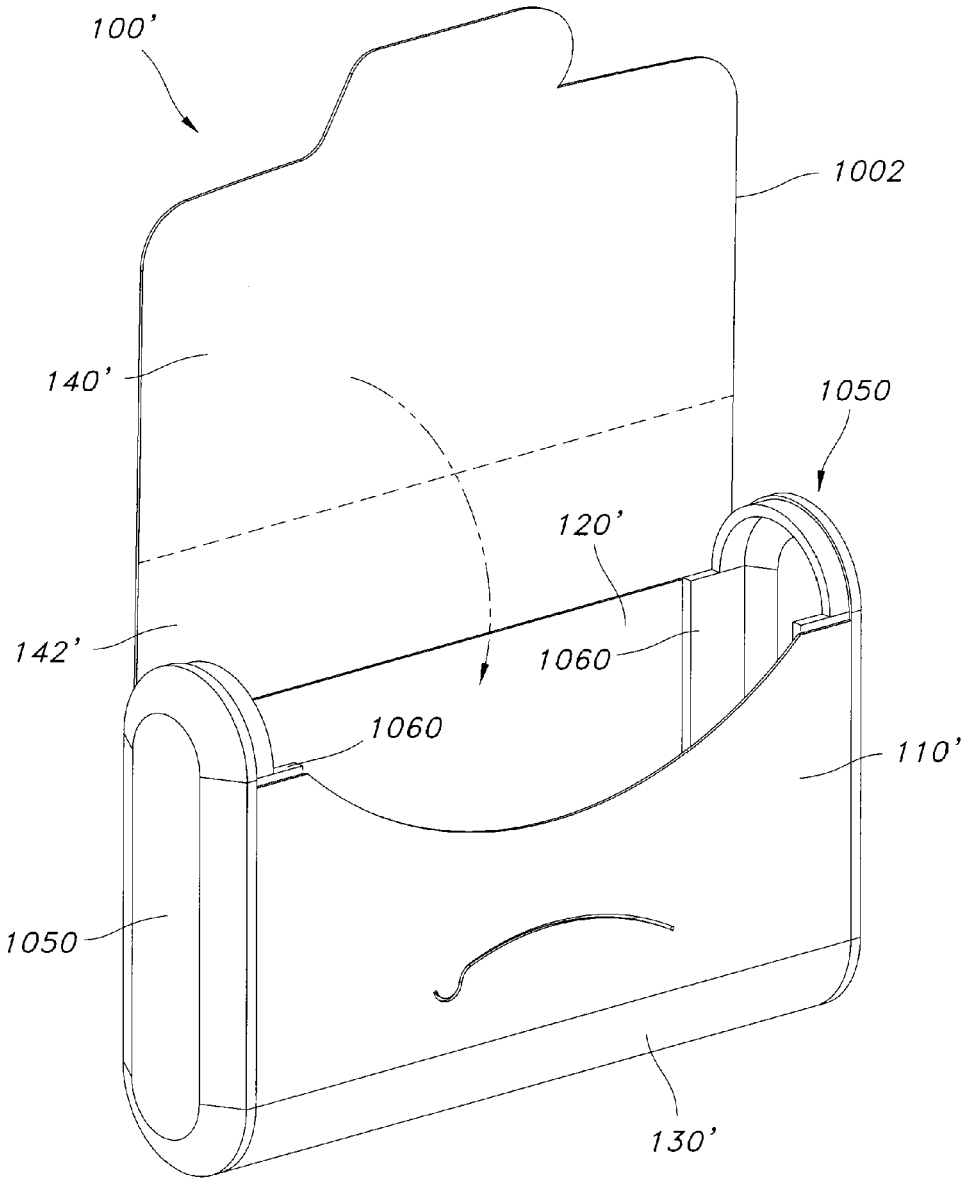
FIGS. 12A-B show alternative packages that can be formed in accordance with preferred embodiments of the present invention.

With reference to FIGS. 10A, 11A, and 12A a package 100' can be formed using blank 1000 and separately formed end caps 1050. The blank 1000 can include a body 1002 that can be constructed of a paperboard or other material of suitable strength for holding one or more comestible products and can have a thickness T. The body 1002 can have the front wall section 410, back wall section 420, bottom wall section 430, and a cover flap section 440.

Referring now to FIGS. 10A and 11A, the end caps 1050 can be used to form the side walls of the package by operatively coupling the end caps 1050 to the body 1002 of the blank 1000, for example, by adhesively joining the end caps 1050 to the body 1002. The end caps 1050 are preferably formed of molded plastic. However, other materials or methods of construction can be used. The end caps 1050 can have an outer wall 1052 with an inner ridge 1054 that extends from an outer perimeter of the outer wall 1052 to a lip 1056 which protrudes from the outer wall 1052 a sufficient distance D so that a perimeter of the inner surface of the blank 1000 can contact the lip 1056 when the blank is wrapped around the lip 1056. The length 1 of the inner ridge 1054 can be substantially equal to the thickness T of the blank 1000 so that when the blank is wrapped around the lip 1056, the side ends of the blank 1000 abut the inner ridge 1054 and the outer surface of the blank 1000 is flush with the outer perimeter of the outer wall 1052. The lip 1056 can be formed to have a continuous perimeter with generally rounded contoured bottom and top ends 1060 and 1062 having a rounded U-shaped configuration, which is similar to the bottom and top ends of those embodiments of the side tabs described above.

The lip 1056 can have generally parallel linear side portions from which outwardly extending tabs 1070 can extend to provide a sufficient area for adhesively or otherwise joining the end caps 1050 to the blank 1000. The outwardly extending tabs 1070 can be used for operatively coupling the end caps 1050 to the body 1002.

To form the package 100', the body 1002 of the blank 1000 can be wrapped around and at least partially secured to the end caps 1050, as shown in FIG. 12A. The front wall section 410 can be adhesively joined to one of the tabs 1070 on each of the end caps 1050 to form the front wall 110' and the back wall section 420 can be adhesively joined to one of the outwardly extending tabs 1070 on each of the end caps 1050 to form the back wall 120'. The bottom wall 130' is form when the front and back wall sections 410 and 420 are operatively coupled to the outwardly extending tabs 1070. The sides of the inner surface of the bottom wall 130' can contact the lip 1056, which can provide additional support to the bottom wall 130' to aid in maintaining the curved surface of the bottom wall 130'.

The cover flap 140' formed by the cover flap section 440 is not joined to the end caps 1050, and therefore, can be selectively moved between open and closed positions. When the cover flap 140' is closed the top wall 142' can conform to the rounded contour of the top ends 1062 of the lip 1056 so that the top wall 142' has a curved surface that follows the curvature of the top ends 1062 of the lip 1056. When the cover flap 140' is closed the sides of the inner surface of the top wall 142' of the package 100' can contact the lip 1056, which can provide additional support to the top wall 142' to aid in maintaining the curved surface of the top wall 142'.

The body 1002 is wrapped around the end caps 1050 such that the side ends of the body 1002 abut the ridge 1006 of the end caps 1050. The body 1002 follows the rounded contours of the lower and upper portions 1052 and 1054 of the end caps. Therefore, the back wall 120' is curves to extend into the bottom and top walls resulting in the rounded bottom wall 130' and top wall 142' of the package 100' and a generally rounded and smooth transition between the back wall 120' and the bottom and top walls 130' and 142'.

Figure 10B:
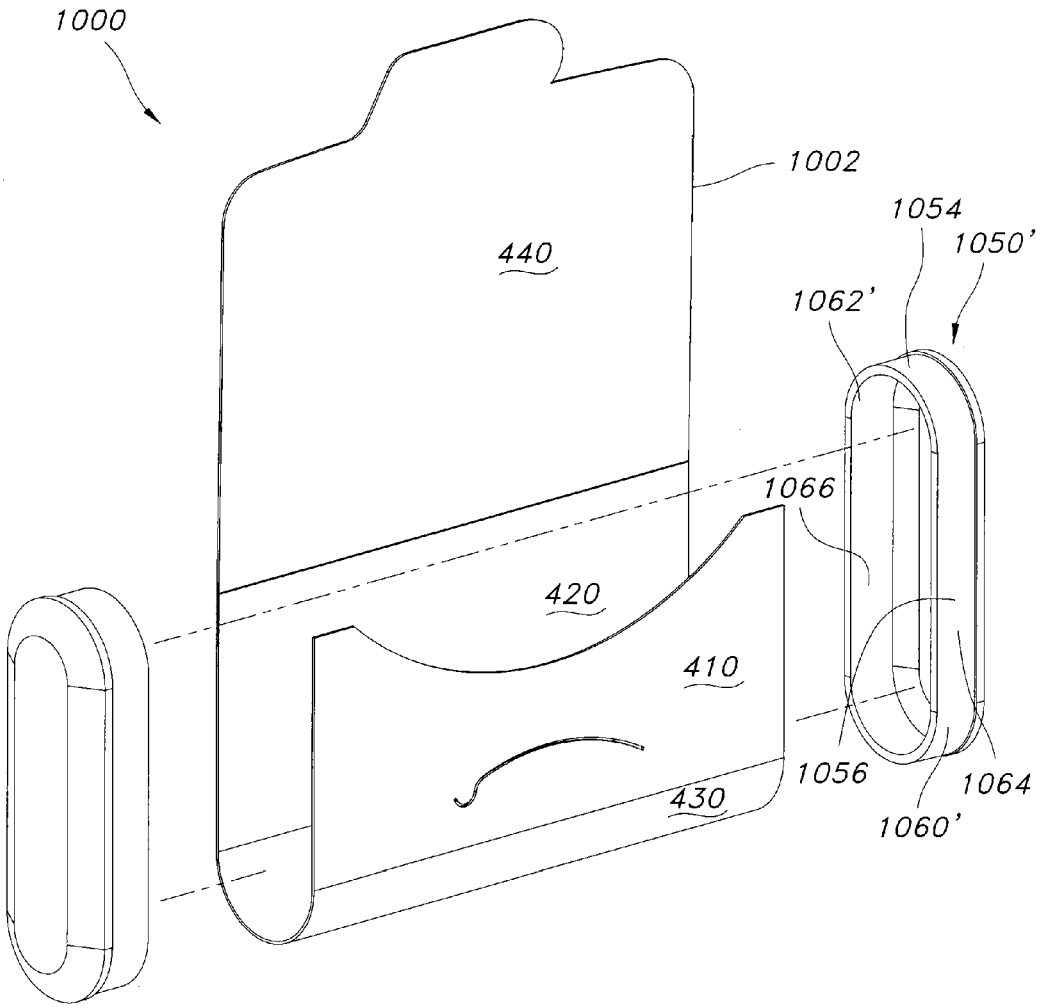
Figure 11B:
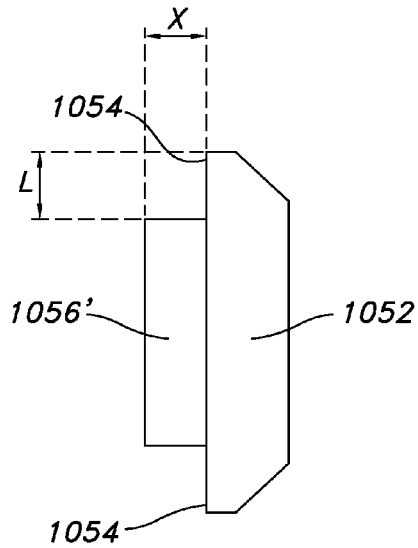
Figure 12B:
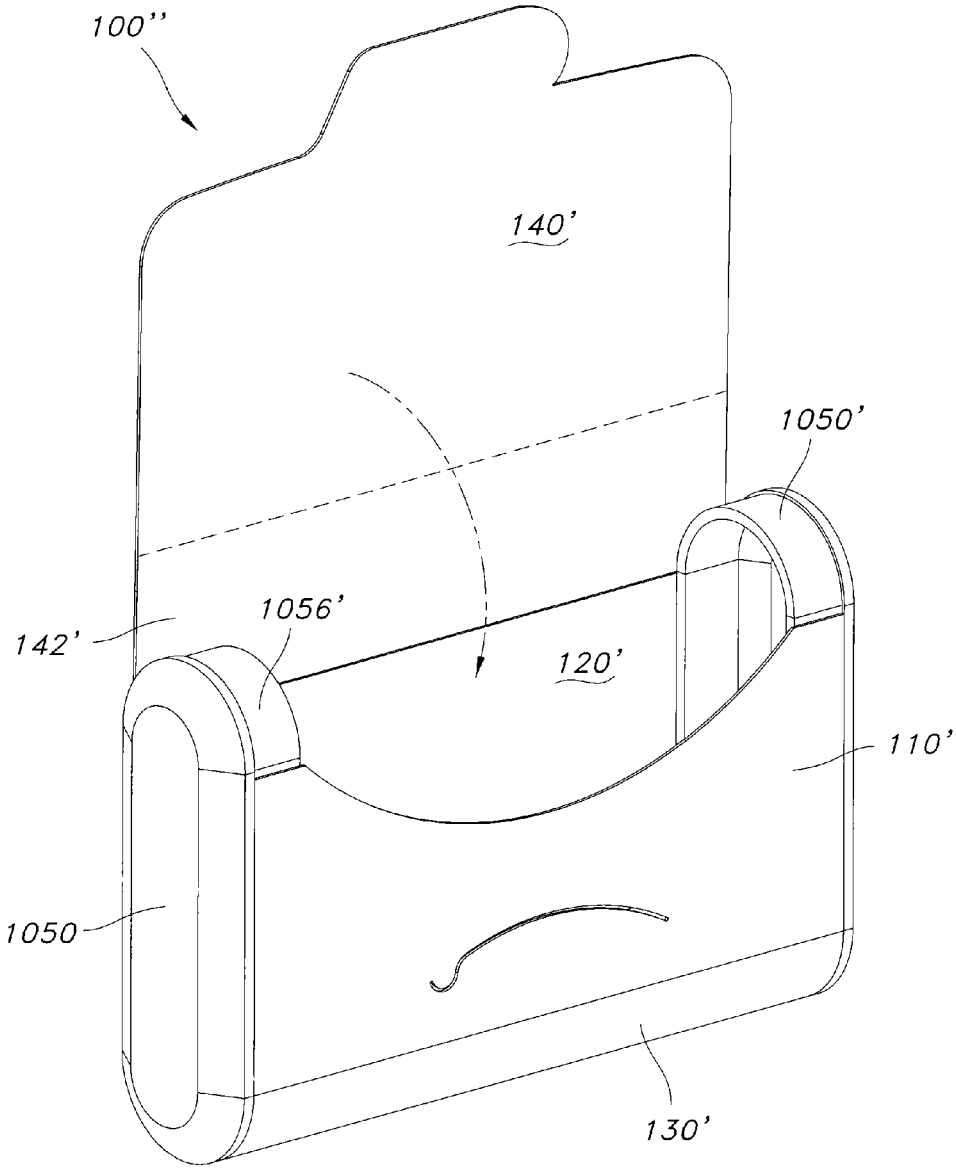

Referring to FIGS. 10B, 11B, and 12B, in an alternative embodiment, end caps 1050' can be used to form the side walls of a package 100". The end caps 1050' can have the outer wall 1052 with the inner ridge 1054 that extends from an outer perimeter of the outer wall 1052 to a lip 1056' which protrudes from the outer wall 1052 a sufficient distance X so that the body 1002 of the blank 100 can be adhesively or otherwise joined to the lip 1056' when the blank is wrapped around the lip 1056'. The lip 1056' can be formed to have a continuous perimeter with the same general rounded contoured bottom and top ends 1060' and 1062' having a rounded U-shaped configuration with side portions 1064' and 1066'. The lip 1056' can be adhesively joined to the front and back wall sections 410 and 420 as wall as to the bottom wall section 430 to form a package 100". The cover flap section 440 is not adhesively or other joined to the side walls 150" so that the cover flap 140" of the package 100" can selective move between an opened and closed position.

Having described the preferred embodiments herein, it should now be appreciated that variations may be made thereto without departing from the contemplated scope of the invention. Accordingly, the preferred embodiments described herein are deemed illustrative rather than limiting, the true scope of the invention being set forth in the claims appended hereto.

What is claimed is:

1. A package for holding one or more comestible products comprising:

a bottom wall, back wall, and front wall forming a compartment;

opposing side walls having rounded contoured top and bottom ends, the opposing side walls being formed from a first set of rounded contoured side tabs continuously formed with at least one of the front wall and the back wall, the first set of rounded contoured tabs each having extended portions extending therefrom the extending portions having a surface adhesively joined to one of the front or back walls, the opposing side walls being operatively coupled to at least one of the front wall and the back wall, the bottom wall conforming to the rounded contoured bottom ends of the side walls wherein the bottom wall is a generally semi-circular curved wall that corresponds to a curvature of the rounded contoured bottom ends of the side walls; and a cover flap extending from the back wall and interfacing with the front wall to close the compartment, the cover flap forming a generally semi-circular curved top wall conforming to the rounded contoured top ends of the opposing side walls when the cover flap is closed so that the top wall has a curved surface that follows a curvature of the rounded top ends of the opposing side walls, wherein a transition between the bottom wall and at least one of the front and back walls is generally rounded and smooth without an abrupt change in direction between surfaces of the bottom wall and the at least one of the front and back walls.

2. The package as defined in claim 1, wherein the bottom wall, the back wall, the front wall, the side walls, and the cover flap are formed from a substantially continuous piece of material.

3. The package as defined in claim 1, wherein the bottom wall, the back wall, the front wall, and the cover flap are formed from a substantially continuous piece of material and the opposing side walls are formed from a different piece of material.

4. The package as defined in claim 1, wherein the opposing side walls are formed of the first set of rounded contoured side tabs and a second set of rounded contoured side tabs so that each of the opposing side walls are formed from at least two side tabs.

5. The package as defined in claim 4, wherein the first set of rounded contoured tabs is continuously formed with the front wall, so that the first set of rounded contoured side tabs extends from the sides of the front wall, and the second set of rounded contoured tabs is continuously formed with the back wall, so that the second set of rounded contoured side tabs extends from the sides of the back wall.

6. The package as defined in claim 1, wherein the sidewalls are each formed of a first and second tab joined together in overlapping relation.

7. A method of forming a package for holding one or more comestible products comprising:

obtaining a blank having at least a front wall section, a back wall section, a bottom section, and side wall tabs having rounded contoured top and bottom ends and substantially linear parallel side ends and having extended portions extending therefrom;

folding at least one of the front wall section and the back wall section towards the other to form a front wall and a back wall, wherein the front wall section and the back wall section have a substantially parallel relation;

forming opposing side walls by folding the side wall tabs disposed on at least one of the front wall section and the back wall section, the side wall tabs folded to be generally orthogonal to at least one of the front and back wall sections and so that inner surfaces of the side wall tabs are facing each other, the opposing side walls being operatively coupled to at least one of the front wall and the back wall;

folding the extended side wall tab portions inwardly so that an inner surface of the extended portion is substantially parallel to at least one of the front wall and the back wall, adhesively joining at least a part of the extended portion to at least one of the front wall and the back wall; and conforming the bottom wall section to the bottom ends of the side wall tabs to form a bottom wall having a curved surface that follows a curvature of the rounded contoured bottom ends of the side walls, wherein the bottom wall has a continuously curving rounded surface extending from the front wall to the back wall.

8. The method as defined in claim 7, wherein the blank comprises side wall tabs and forming opposing side walls comprises:

folding a first side wall tab and a second side wall tab opposed to the first side wall tab to be generally orthogonal to the front wall section and so that inner surfaces of the first and second side wall tabs are facing each other, the third and fourth side wall tabs having rounded contoured top and bottom ends and substantially linear parallel side ends and being disposed on the front wall section;

folding a third side wall tab and a fourth side wall tab opposed to the third side wall tab to be generally orthogonal to the back wall section and so that inner surfaces of the third and fourth side wall tabs are facing each other, the third and fourth side wall tabs having rounded contoured top and bottom ends and substantially linear parallel side ends and being disposed on the back wall section; and joining a first and third side wall tab in substantially overlapping relation so that an inner surface of the first side wall tab is joined to an outer surface of the third side wall tab.

9. The method as defined in claim 7, wherein the blank comprises a cover flap section and the method further comprising:

forming a cover flap from the cover flap section, which extends from the back wall section; and forming a top wall from a portion of the cover flap when the cover flap is in a closed position, the top wall conforming to the top ends of the side walls to form a top wall having a curved surface that follows a curvature of the rounded contoured bottom ends of the side walls.

10. The method as defined in claim 7, wherein forming opposing side walls comprises joining end caps to at least the front and back sections of the blank, the end caps having an outer perimeter, an inner perimeter ridge, and outwardly extending tabs, the inner perimeter ridge having a smaller perimeter than the outer perimeter and the outwardly extending tabs extending from the inner perimeter ridge.

11. The method as defined in claim 7 further comprising:

forming a compartment with the front, back, and bottom walls; and inserting a comestible product into the compartment.

12. A package for holding one or more comestible products comprising:

a bottom wall, back wall, front wall, cover flap, and opposing side walls continuously formed from a single piece of material to provide a compartment for holding one or more comestible products, the opposing side walls having rounded contoured top and bottom ends, the opposing side walls being formed from a first set of rounded contoured side tabs continuously formed with at least one of the front wall and the back wall, the first set of rounded contoured tabs each having extended portions extending therefrom the extending portions having a surface adhesively joined to one of the front or back walls, the bottom wall conforming to the rounded contoured bottom ends of the side walls so that the bottom wall has a generally semi-circular curved surface extending between the front and back walls that conforms to a curvature of the rounded contoured bottom ends of the side walls, the cover flap extending from the back wall and interfacing with the front wall to selectively close the compartment, the cover flap forming a top wall having a generally semi-circular curved surface extending between the front and back walls and conforming to the rounded contoured top ends of the opposing side walls when the cover flap is closed, so that the top wall has a curved surface that follows a curvature of the rounded top ends of the opposing side walls.

13. The package as defined in claim 12, wherein the opposing side walls are formed of the first set of rounded contoured side tabs and a second set of rounded contoured side tabs so that each of the opposing side walls are formed from at least two side tabs.

* * * * *